United States Patent [19]

Stastney

[11] 4,414,716

[45] Nov. 15, 1983

[54] GARMENT CLASPING DEVICE

[76] Inventor: Frank Stastney, 2nd & Dotts Sts., Apt. D-210, Pennsburg, Pa. 18073

[21] Appl. No.: 308,398

[22] Filed: Oct. 5, 1981

[51] Int. Cl.[3] ..... A44B 21/00

[52] U.S. Cl. ..... 24/3 L; 24/336; 24/DIG. 29; 24/561; 24/563; 24/647; 24/326

[58] Field of Search ..... 24/3 L, DIG. 29, DIG. 9, 24/30.5 S, 67.9, 336, 129 B, 130, 201 A, 201 HE, 226, 225, 264, 208 R, 208 A; 40/1.5, 124.4; D2/414

[56] References Cited

U.S. PATENT DOCUMENTS

| | | | |
|---|---|---|---|
| 1,306,369 | 6/1919 | Bell | 24/129 B |
| 1,485,266 | 2/1924 | Hennah | 24/264 |
| 1,487,387 | 3/1924 | Hurlbutt | 24/201 HE |
| 2,204,117 | 6/1940 | Brammer | 24/130 |
| 2,981,990 | 5/1961 | Balderree, Jr. | 24/30.5 S |
| 3,774,267 | 11/1973 | Sneider | 24/129 B |
| 3,822,441 | 7/1974 | Paxton | 24/30.5 S |

*Primary Examiner*—John J. Wilson
*Attorney, Agent, or Firm*—Ruth Moyerman

[57] ABSTRACT

A clasping device for releasably securing small articles of clothing such as socks is disclosed. In the clasping device of this invention, a device consisting of one or two small, flat, resilient members are utilized to pair socks or the like for washing and storage. The garments are secured by inserting them through a divisionary cut extending from an edge of the clasping device to an eliptical aperture.

In one embodiment, two members are used, each intended to secure one sock and the members are held together by slipping an H-shaped arm of the H into a circular aperture of the second member by twisting and slipping the two together through a divisionary cut in the second member.

An alternate embodiment contemplates one member having two or more divisionary cuts and apertures through which garments may be slipped and caught and later released for use.

2 Claims, 6 Drawing Figures

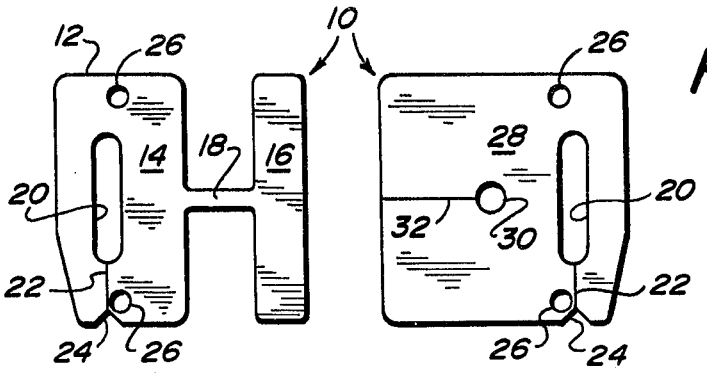
FIG. 1
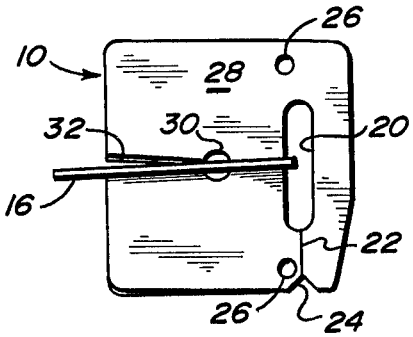
FIG. 2
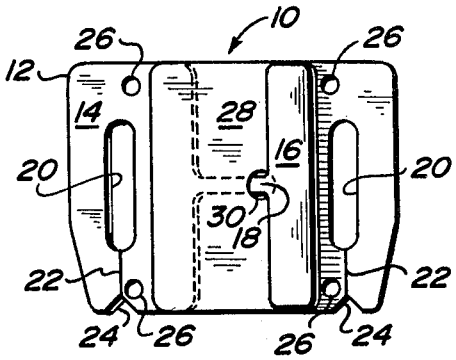
FIG. 3
FIG. 5
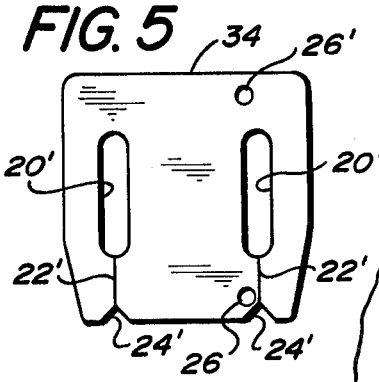
FIG. 6
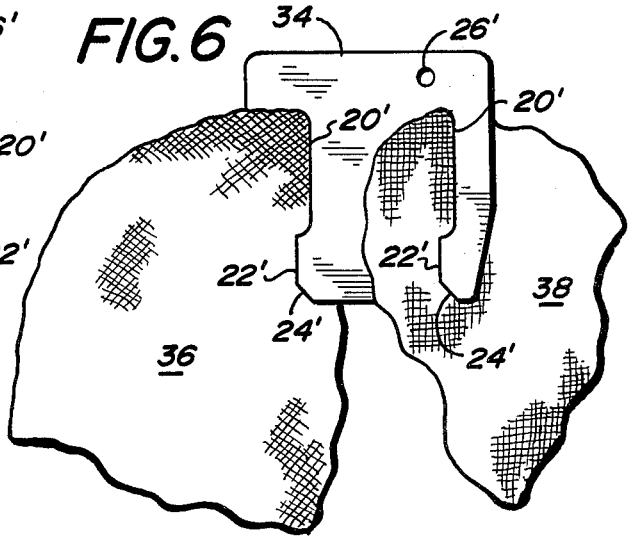
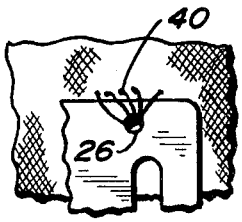
FIG. 4

GARMENT CLASPING DEVICE

BACKGROUND OF THE INVENTION

1. Field of the Invention

This invention relates to clasps and more particularly to combined fasteners.

2. Description of the Prior Art

The problem of fastening small articles of clothing or garments together for washing, storing and the like is well known. Over the years, large numbers of various types of clasps have been proposed. Examples appear as early as U.S. Pat. Nos. 29,819 and 1,859,817 and extend to more recent proposals of which U.S. Pat. Nos. 2,779,076; 3,170,213; 3,346,927; 3,673,639; 3,688,348; 3,699,617; 3,774,267; 3,972,094; 4,058,853 and 4,165,555 are examples.

Each of the aforementioned devices has drawbacks, either because they lack universality, they are too clumsy to use, or their design is such that it is impossible to adapt them to a very small size.

There is therefore still a need for a garment clasper, one which is particularly suitable for pairing socks and which is readily adaptable to being either permanently attached to the sock or releasably securable thereto to accommodate those users who do not want a permanent attachment.

SUMMARY OF THE INVENTION

The aforementioned prior art problems are solved by the garment clasper of this invention which includes two embodiments, either of which may be permanently or releasably secured to a garment.

One embodiment contemplates a single, flat, resilient member including one, a pair, or more, of eliptical apertures and a divisionary cut through the member from its edge to each aperture. In this embodiment, each sock or garment may be slipped along the cut by flexing the device and will remain secured within the member's aperture by the natural rebounding of the device. Means may also be provided whereby the device may be sewn to one garment, if such is desired.

In a second embodiment, two flat, resilient members are employed, each of which includes at least one of the aforementioned apertures and divisionary cuts. However, the device members in this embodiment may themselves be joined together. Joining is accomplished by providing one member as H-shaped, one arm of the H becoming a male fitting. The second member in this embodiment includes, as well as the aforementioned aperture, another generally circular aperture with accompanying divisionary cut. The second circular aperture provides the female fitting. The two are joined together by inserting, in a twisting motion, the cross member of the H through the divisionary cut of the receiving female member to interlock the leg of the H within the female member aperture.

It is therefore an object of this invention to provide a universal garment clasping device to enable socks or the like small articles of clothing to be secured together for washing, storage, etc.

It is still another object of this invention to provide the aforementioned clasping device as a small, unobtrusive device such as may be attached permanently to a sock without any discomfort to the wearer.

It is yet another object of this invention to provide a clasping device which, although small in size, is nonetheless easy to use by those with stiff or weak fingers or poor eyesight.

It is yet another object of this invention to provide a clasping device which is inexpensive to manufacture, rugged in construction, lightweight yet sturdy enough to perform during wash cycles with garments of various weights and sizes, whether heavy woolens or lightweight dacrons and nylons.

BRIEF DESCRIPTION OF THE DRAWING(S)

FIG. 1 illustrates a preferred embodiment of this invention showing the members separated.

FIG. 2 illustrates the embodiment shown in FIGS. 1 as it would appear during interlocking of the members.

FIG. 3 illustrates the embodiment shown in FIG. 1 with the members fully interlocked.

FIG. 4 illustrates a partial view of the device of this invention shown sewn to a garment.

FIG. 5 illustrates an alternate embodiment of the device of this invention.

FIG. 6 illustrates the embodiment shown in FIG. 5 in use.

DETAILED DESCRIPTION OF THE PREFERRED EMBODIMENT(S)

Referring now to the drawings, and more particularly to FIGS. 1, 2 and 3, a preferred embodiment of garment clasping device 10 is shown. Clasping device 10 comprises two members, body member 12 which is H-shaped and includes clasper leg 14, male fitting leg 16 and cross arm 18. Clasper leg 14 includes aperture 20 which is generally an eliptical aperture and divisionary cut 22 which runs from aperture 20 to notch 24 at the edge of body member 12. The function of aperture 20, cut 22 and notch 24 will be explained in reference to FIG. 3. Body member 12 also includes two circular apertures 26.

FIGS. 1, 2 and 3 also include the reciprocal member of clasping device 10 which includes body member 28, eliptical aperture 20, divisionary cuts 22, and notch 24. Similarly, a pair of circular apertures 26 near the top and bottom of aperture 20 are also included. Additionally, body member 28 includes aperture 30 and divisionary cut 32 which extend from aperture 30 to the edge of body member 28.

The relationship between body member 12 and body member 28 may be readily ascertainable by reference to FIGS. 2 and 3 which show the interlocking of the two members. In use, a sock or similar garment would be affixed to each body member, either by sliding the garment through each of cuts 22 beginning at each of notches 24 until a piece of the garment was caught in aperture 20, or by sewing one garment to one of device 10 members and sliding the other garment through the cuts as just previously described. By this is meant that the garment and the body member may be more or less permanently secured together by, for example, overcast stitching of the garment through either or both apertures 26 as shown in FIG. 4 where aperture 26 is shown with overcast stitching 40. In either example, that is whether the sock or garment is releasably or more permanently attached to a body member, when it is desired to secure the two socks or garments together for washing, the two body members may be temporarily linked by sliding cross arm 18 through divisionary cut 32 to link male fitting leg 16 into aperture 30 which becomes the female half of the fitting as shown in FIGS. 2 and 3. Both body members of clasper 10 are illustrated as flat, resilient members, preferably pastic, and the resilient feature of the material of construction would allow the members to be pressed apart at their divisionary cuts either to receive the garment or, as shown particularly in FIG. 2, to allow the male/female connection of the two members themselves.

Thus, it may be seen that clasper 10 is universal in construction, appealing to both users who would like the device permanently affixed to their socks, and to others who prefer a removable clasp.

Referring now to FIGS. 5 and 6, an alternate embodiment, clasping device 34, is shown. In clasping device 34, also a flat, resilient construction, two apertures 20' are utilized together with accompanying divisionary cuts 22' ending in notches 24'. Also present in clasping device 34 are a pair of circular apertures 26'. The alternate embodiment shown in FIGS. 4 and 5 may also be either a permanent or temporary attachment to one of the garment members. For example, in the case of a pair of socks in which the user does not want to wear the socks while the clasping device is attached, then with reference to FIG. 5, the device is used by inserting garments 36 and 38 into one each of apertures 20 before being put into the washing machine. On the other hand, for those that prefer permanent attachment, clasping device 34 may be permanently sewn to one garment as, for example, by overcast stitching through aperture 26 as shown in FIG. 4 in which case only one of apertures 20 would customarily be utilized to secure two garments.

Having now illustrated my invention, it is not my intention that such illustration be limited to the invention as shown, but that the invention be limited only by reasonable interpretation of the apended claims.

What is claimed is:

1. A clasping device for releasably securing small articles of clothing together for washing, storing or the like comprising:

(a) at least one flat, resilient H-shaped member, one leg of said H having at least one generally eliptical aperture therein and a divisionary cut extending from an edge of said member to said aperture, and said other leg providing the male fitting for (b) a second, flat, resilient member having a generally eliptical aperture therein and a divisionary cut extending from an edge of said member to said aperture, said second member also including a second generally circular aperture and a second divisionary cut extending from an edge of said member to said second aperture, said second aperture providing the female fitting having said male member removably received therein, whereby said first and second members provide separable removably coupled garment claspers when a garment section is slipped within and along said cut by flexing said member at its cut edge and thereafter said garment is held by said member's rebounding.

2. The device according to claim 1 wherein each member comprises a notched intersection of each of said divisionary cuts and its corresponding member edge.

* * * * *